US009538838B2

(12) United States Patent
Tominaga

(10) Patent No.: US 9,538,838 B2
(45) Date of Patent: Jan. 10, 2017

(54) PROCESSING BRUSH AND BRUSH-TYPE PROCESSING DEVICE

(75) Inventor: Kazuto Tominaga, Nagoya (JP)

(73) Assignees: FUMIO OOTA, Nisshin, Aichi (JP); YUGENKAISHA HONMASHOKAI, Nagoya (JP); TADAKI HONMA, Nagoya (JP)

( * ) Notice: Subject to any disclaimer, the term of this patent is extended or adjusted under 35 U.S.C. 154(b) by 481 days.

(21) Appl. No.: 14/126,832

(22) PCT Filed: Sep. 13, 2011

(86) PCT No.: PCT/JP2011/070879

§ 371 (c)(1),
(2), (4) Date: Dec. 16, 2013

(87) PCT Pub. No.: WO2013/038507

PCT Pub. Date: Mar. 21, 2013

(65) Prior Publication Data

US 2014/0115798 A1 May 1, 2014

(51) Int. Cl.

| | |
|---|---|
| ***A46B 13/02*** | (2006.01) |
| ***B08B 1/04*** | (2006.01) |
| ***A46B 5/00*** | (2006.01) |
| ***B08B 1/00*** | (2006.01) |
| ***B24B 23/04*** | (2006.01) |
| ***B24B 29/00*** | (2006.01) |

(52) U.S. Cl.

CPC ..... *A46B 13/02* (2013.01); *A46B 5/0095* (2013.01); *B08B 1/002* (2013.01); *B08B 1/04* (2013.01); *B24B 23/043* (2013.01); *B24B 29/005* (2013.01); *A46B 2200/30* (2013.01)

(58) Field of Classification Search

CPC ..... A46B 13/02; A46B 5/0095; B08B 1/002; B08B 1/04; B24B 23/043; B24B 29/005

See application file for complete search history.

(56) References Cited

U.S. PATENT DOCUMENTS

| | | | | |
|---|---|---|---|---|
| 3,216,734 A * | 11/1965 | Thompson | B25D 17/005 | 15/22.1 |
| 5,822,821 A * | 10/1998 | Sham | A46B 13/02 | 15/22.1 |
| 2005/0144744 A1* | 7/2005 | Thiess et al. | A46B 5/0075 | 15/22.1 |

FOREIGN PATENT DOCUMENTS

JP 2009-78055 A1 4/2009

* cited by examiner

*Primary Examiner* — Shay Karls
(74) *Attorney, Agent, or Firm* — Procopio, Cory, Hargreaves & Savitch LLP

(57) ABSTRACT

In a brush-type processing device, a base portion of a processing brush is fixed to a reciprocating rotating shaft provided to a drive source. A brush portion extends from the base portion to one side along the radius of the reciprocating rotating shaft. When the reciprocating rotating shaft reciprocatingly rotates, a plurality of brush bristles of the brush portion reciprocatingly oscillates in a circumferential direction of the reciprocating rotating shaft. Accordingly, an object to be removed on a processed surface can be scraped off by allowing distal ends of the brush bristles to be pressed against the processed surface. In this case, the distal ends of the brush bristles that reciprocatingly oscillate repeatedly collide with the object to be removed from both sides in a reciprocating oscillation direction, thereby making it possible to effectively remove the object to be removed.

2 Claims, 6 Drawing Sheets

PROCESSING BRUSH AND BRUSH-TYPE PROCESSING DEVICE

TECHNICAL FIELD

The present invention relates to a processing brush for use in various processings such as deflashing, grinding, polishing, rubbing-up, washing, and finishing of a processed surface, and a brush-type processing device including the processing brush.

BACKGROUND ART

A processing brush disclosed in Patent Literature 1 mentioned below has a structure in which a rotating shaft is coaxially provided on one side surface in an axial direction of a base unit which is formed in a disk shape, and a brush unit is mounted on the other side surface in the axial direction of the base unit. In such a processing brush, the rotating shaft of the base unit is mounted to a drive source (rotation actuator) to rotate the entire processing brush, thereby allowing the brush unit to be pressed against a processed surface. This leads to a removal of an object to be removed (such as a flash) from the processed surface.

CITATION LIST

Patent Literature

Patent Literature 1: Japanese Unexamined Patent Application Publication No. 2009-78055

SUMMARY OF INVENTION

Technical Problem

In the processing brush described above, however, the brush unit extends in the axial direction of the rotating shaft. Thus, during rotation of a bracket unit, the rotational speed at an inside portion in the radius direction of the brush unit is lower than the rotational speed at an outside portion in the radius direction. This may cause occurrence of unevenness in the processing. To eliminate the unevenness, it is necessary to repeatedly perform the operation. Therefore, there is a room for improvement in the processing efficiency.

In view of the above-mentioned circumstances, it is an object of the present invention to provide a processing brush and a brush-type processing device which can improve the processing efficiency.

Solution to Problem

A processing brush according to an exemplary implementation includes: a base portion formed so as to be fixed to a reciprocating rotating shaft, the reciprocating rotating shaft being provided to a drive source and reciprocatingly rotating about an axis; and a brush portion that extends from the base portion to one side along a radius of the reciprocating rotating shaft and reciprocatingly oscillates in a circumferential direction of the reciprocating rotating shaft by the reciprocating rotation of the reciprocating rotating shaft.

During use, the base portion is fixed to the reciprocating rotation that is provided to the drive source. The brush portion extends from the base portion to one side along the radius of the reciprocating rotating shaft. Accordingly, the reciprocating rotation of the reciprocating rotating shaft by a driving force of the drive source allows the brush portion of the processing brush to reciprocatingly oscillate in the circumferential direction of the reciprocating rotating shaft. This structure permits distal ends of brush bristles of the brush portion to be pressed against a processed surface, thereby allowing the distal ends of the brush bristles to scrape off (knock out) an object to be removed (flash, dirt, etc.) on the processed surface. Additionally, in this case, the distal ends of the brush bristles, which reciprocatingly oscillate, repeatedly collide with the object to be removed from both sides in a reciprocatingly oscillating direction, thereby making it possible to effectively eliminate the object to be removed. Further, since the brush portion extends to one side along the radius of the reciprocating rotating shaft, the speed of the reciprocating oscillation of the distal ends of the brush bristles of the brush portion can be made constant or substantially constant, regardless of a location. This prevents or suppresses occurrence of unevenness in the processing. Furthermore, since the base portion is fixed to the reciprocating rotating shaft of the drive source, it is possible to directly transmit a torque of the reciprocating rotating shaft to the brush portion extending from the base portion, and to allow the brush portion to reciprocatingly oscillate strongly. In view of the above, according to the present invention, various processings such as deflashing, grinding, polishing, rubbing-up, washing, and finishing of the processed surface can be efficiently performed with high accuracy.

According to a processing brush of an exemplary implementation, the base portion includes: a brush mounting portion fitted with a bottom of the brush portion; and a fixation portion extending from one end of the brush mounting portion to a side opposite to the brush portion, and the fixation portion is fixed to the reciprocating rotating shaft such that the brush mounting portion is formed along the reciprocating rotating shaft and the brush portion extends to a side opposite to the reciprocating rotating shaft through the brush mounting portion.

When the fixation portion provided to the base portion is fixed to the reciprocating rotating shaft of the drive source, the brush mounting portion provided to the base portion is disposed along the reciprocating rotating shaft, and the brush portion (brush bristles) extends to the side opposite to the reciprocating rotating shaft (drive source) through the brush mounting portion. This structure facilitates application of a force, for example, when the drive source is gripped to press the brush bristles against the processed surface.

According to an exemplary implementation, the base portion is formed by bending a long metal sheet material at an intermediate portion in a longitudinal direction, and one end side in the longitudinal direction of the metal sheet material from a bent potion serves as the fixation portion, and the other end side in the longitudinal direction of the metal sheet material from the bent portion serves as the brush mounting portion.

The base portion is formed by bending the long metal sheet material at the intermediate portion in the longitudinal direction, thereby making it possible to form the base portion with a compact, simple structure and to reduce costs.

The brush portion includes brush bristles formed of nylon, and the brush bristles have a diameter in a range of 0.5 ϕ to 5 ϕ and a bristle length in a range of 5 mm to 200 mm.

The diameter of each of the brush bristles formed of nylon is set to be relatively large as described above, which makes it possible to effectively remove the object to be removed on the processed surface. Further, the bristle length of each of the brush bristles is set to be relatively long, which allows the brush bristles to be favorably warped and to favorably follow the irregularities of the processed surface. Moreover, the distal ends of the brush bristles can be easily inserted into a narrow gap, thereby facilitating processing of a narrow gap. This leads to a further improvement of the processing efficiency.

A rotation of the base portion relative to the reciprocating rotating shaft is regulated by allowing an engaged portion provided to the fixation portion to be engaged with an engaging portion provided to the reciprocating rotating shaft, and a mounting angle of the base portion with respect to the reciprocating rotating shaft is variable in a plurality of steps in the circumferential direction of the reciprocating rotating shaft.

The rotation of the base portion relative to the reciprocating rotating shaft of the drive source can be regulated, and the mounting angle of the base portion with respect to the reciprocating rotating shaft is variable in a plurality of steps in the circumferential direction of the reciprocating rotating shaft. This structure makes it possible to change the mounting angle of the base portion with respect to the reciprocating rotating shaft (drive source), i.e., the direction in which the brush bristles project from the reciprocating rotating shaft (drive source), depending on the operation, thereby improving the workability.

A brush-type processing device according to an exemplary implementation includes: a drive source that causes a reciprocating rotating shaft to reciprocatingly rotate by a driving force; and a processing brush according to any one of the previous examples, the base portion being fixed to the reciprocating rotating shaft.

When the reciprocating rotating shaft is allowed to reciprocatingly rotate by a driving force of the drive source, a plurality of brush bristles of the processing brush whose base portion is fixed to the reciprocating rotating shaft reciprocatingly oscillates in the circumferential direction of the reciprocating rotating shaft. This processing brush is set forth herein, and thus the above-mentioned operations and effects can be obtained.

Advantageous Effects of Invention

As described above, a processing brush and a brush-type processing device according to the present invention are capable of improving the processing efficiency.

DESCRIPTION OF EMBODIMENTS

Hereinafter, a processing brush 10 and a brush-type processing device 12 according to an embodiment of the present invention will be described with reference to FIGS. 1 to 5.

(Structure)

Figure 1:
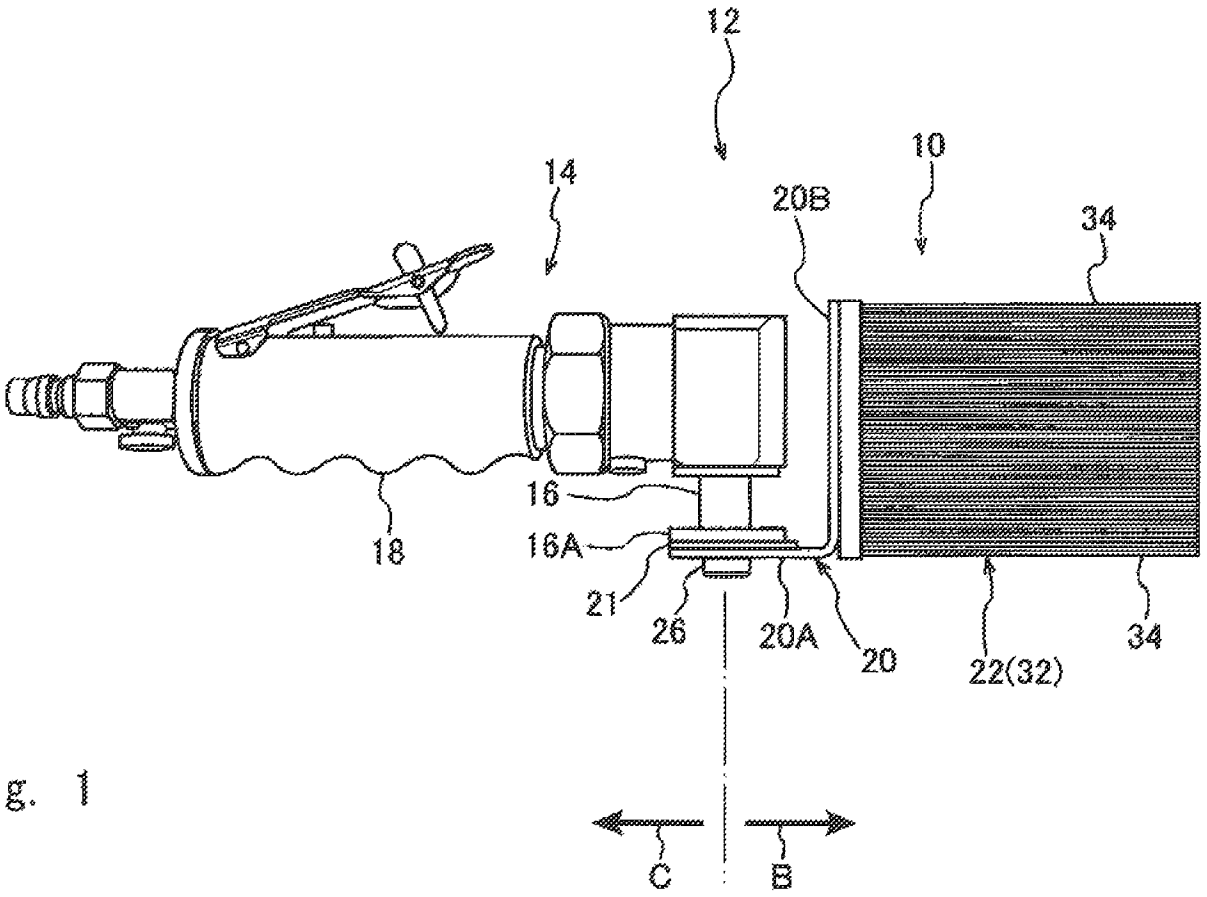
FIG. 1 is a side view of a brush-type processing device according to an embodiment of the present invention.
Figure 2:
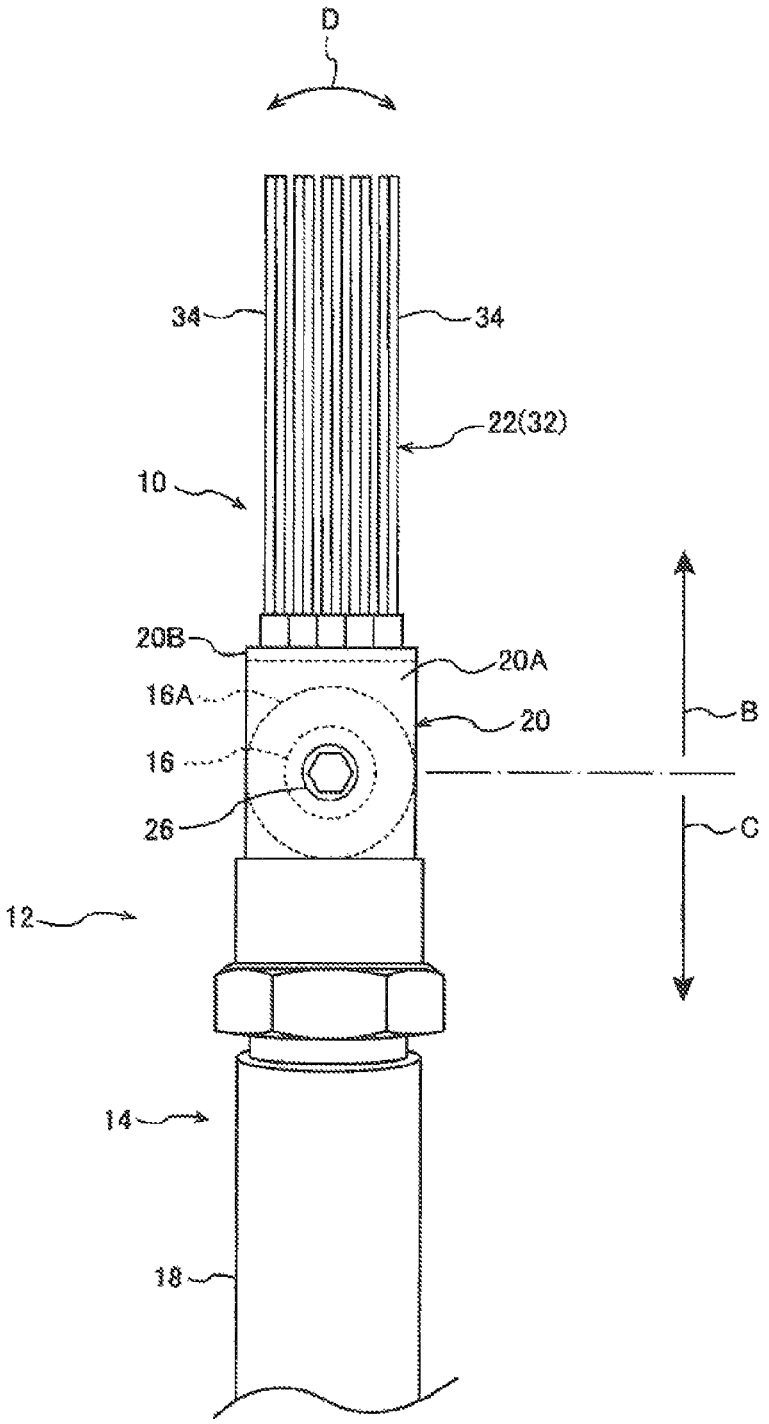
FIG. 2 is a front view showing a structure of a main part of the brush-type processing device.

The brush-type processing device 12 (brush-type processing machine) according to this embodiment is used for various processings such as deflashing, grinding, polishing, rubbing-up (including cleaning), washing (including stain removal), and finishing of a processed surface. As shown in FIGS. 1 and 2, the brush-type processing device is composed of a drive source 14 and the processing brush 10 which is mounted to a reciprocating rotating shaft 16 of the drive source 14. The drive source 14 includes a body portion 18 which can be gripped by an operator. The drive source 14 has a structure in which the reciprocating rotating shaft 16 protruding in a direction perpendicular to the longitudinal direction of the body portion 18 from one end in the longitudinal direction of the body portion 18 is caused to reciprocatingly rotate by a driving force.

As the drive source 14 described above, "oscillation action thunder 505N" manufactured by COMPACT TOOL CO. LTD. can be used, for example. This "oscillation action thunder 505N" has a structure in which a spindle (reciprocating rotating shaft) is caused to reciprocatingly rotate by a pressure of compressed air and the spindle having a stroke (amplitude) of 5 degrees is caused to reciprocatingly rotate at a rotational speed of 15000 st/min. The drive source 14 is not limited to a pneumatic type. An electric motor-driven type or other drive types may also be used. The stroke of the reciprocating rotating shaft is set in the range of 2 to 20 degrees (the optimum value of the stroke varies depending on the diameter of each brush bristle 34 described later), and the rotational speed is preferably set at 10000 st/min or higher.

Figure 3:
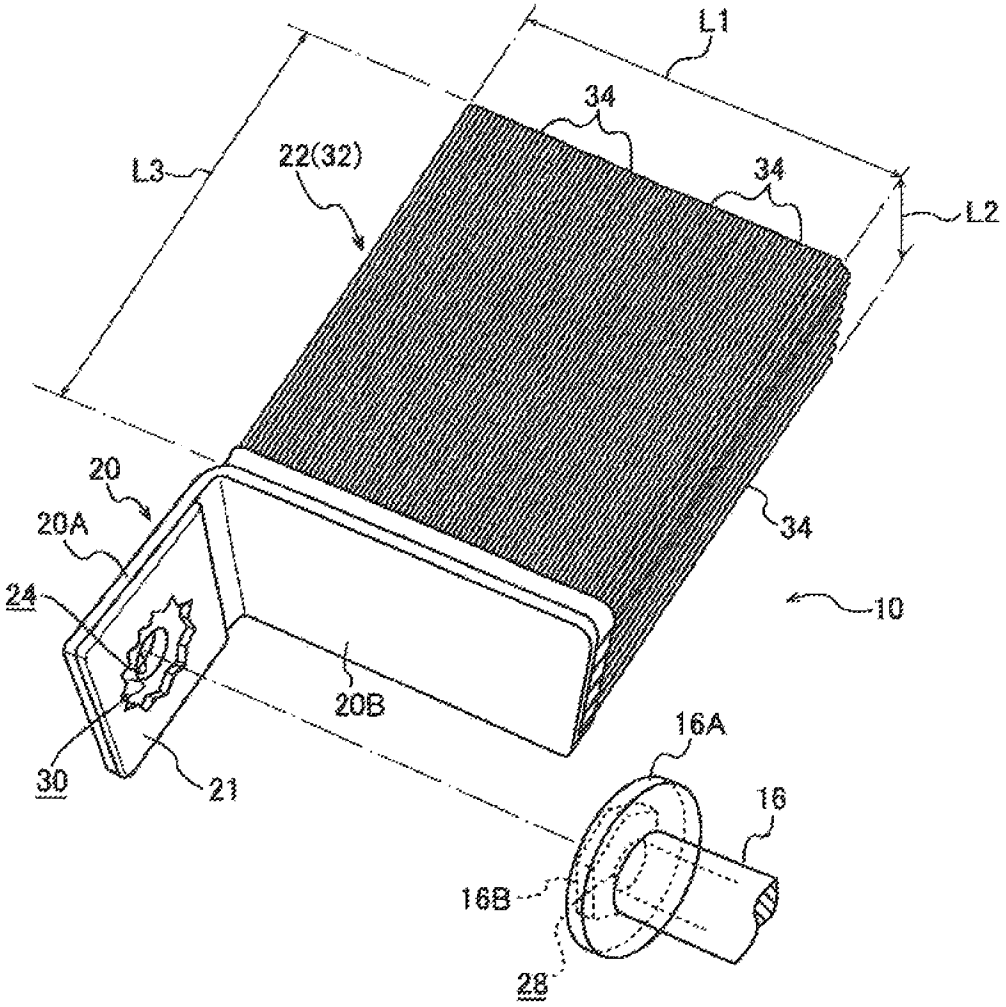
FIG. 3 is an exploded perspective view showing structures of a processing brush and a reciprocating rotating shaft of the brush-type processing device.
Figure 4:
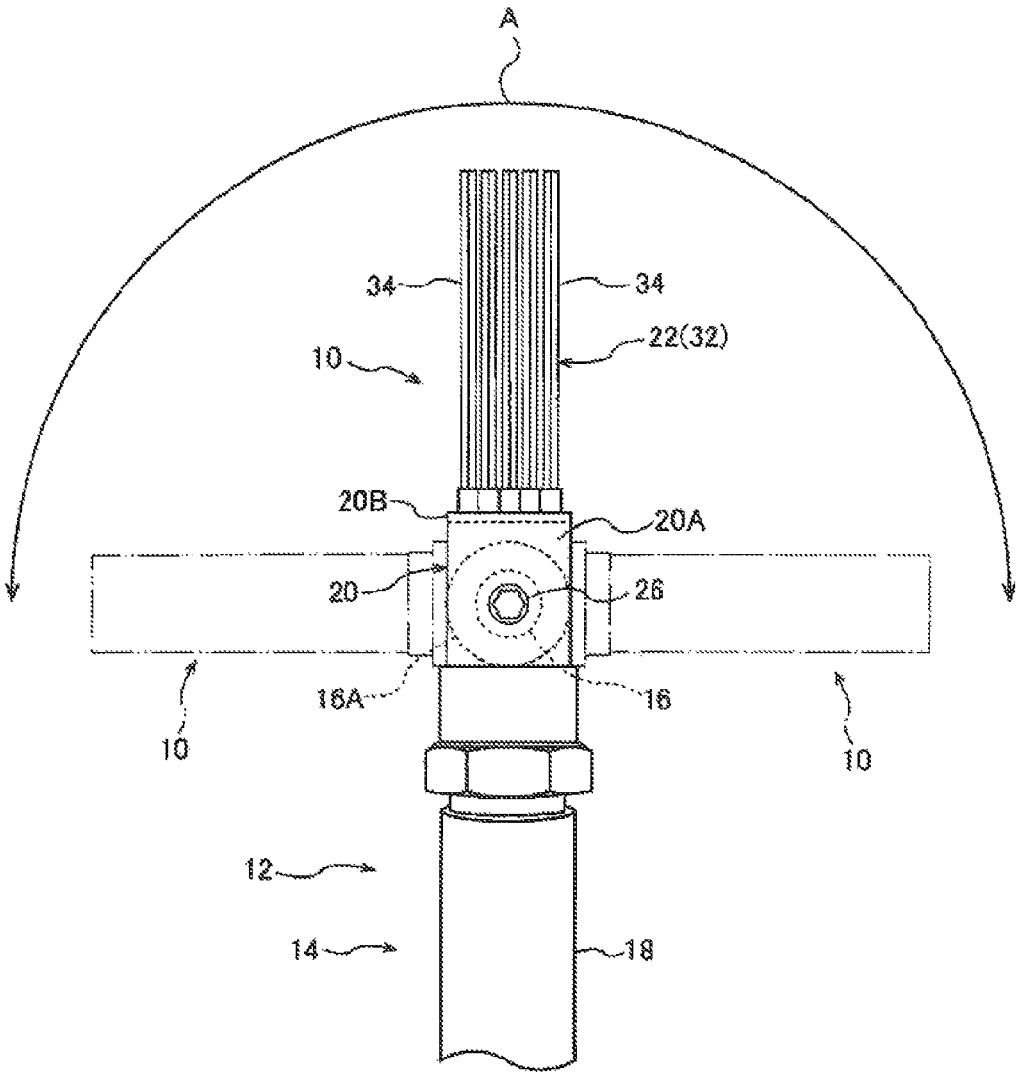
FIG. 4 is a front view corresponding to FIG. 2 for explaining a change of a mounting angle of the processing brush with respect to the reciprocating rotating shaft in the brush-type processing device.

As shown in FIGS. 1 to 3, the processing brush 10 includes a base portion 20 which is fixed to the reciprocating rotating shaft 16, and a brush portion 22 which is mounted to the base portion 20. The base portion 20 is formed in an L-shape in such a manner that a long metal sheet material is bent substantially perpendicularly at an intermediate portion in the longitudinal direction. A portion on one end side in the longitudinal direction of the bent portion of the metal sheet material serves as a fixation portion 20A, and a portion on the other end side in the longitudinal direction of the bent portion of the metal sheet material serves as a brush mounting portion 20B. The brush mounting portion 20B extends substantially perpendicular to one side in the thickness direction of the fixation portion 20A from one end of the fixation portion 20A, and is formed to be longer than the fixation portion 20A.

One surface (surface on the side from which the brush mounting portion 20B extends) of the fixation portion 20A is joined with a rotation regulating portion 21 (engaged portion), which is formed of a metal sheet material with a thickness smaller than that of the metal sheet material forming the base portion 20, by means of welding or the like. This rotation regulating portion 21 has a dodecagonal hole 30 (through-hole). On the inner periphery of the dodecagonal hole 30, a concavo-convex pattern similar to that on the inner periphery of a bihexagon wrench is formed. A through-hole 24 concentric to the dodecagonal hole 30 is formed in a central portion of the fixation portion 20A. A bolt 26 (a hexagon socket head bolt in this case) which is inserted into the through-hole 24 is screwed into a screw hole 28 that is formed in a distal end (one end in the axial direction) of the reciprocating rotating shaft 16. This permits the base portion 20 to be fixed to the distal end of the reciprocating rotating shaft 16.

In the above-mentioned fixed state, a flange portion 16A which is formed at the distal end of the reciprocating rotating shaft 16 is in surface contact with the rotation regulating portion 21, thereby regulating the inclination of the base portion 20 with respect to the reciprocating rotating shaft 16. The brush mounting portion 20B extends from the fixation portion 20A toward the proximal end side (the other end side in the axial direction) of the reciprocating rotating shaft 16, and is disposed substantially parallel with the reciprocating rotating shaft 16. Further, a hexagonal convex portion 16B (engaging portion) which is formed at the distal end of the reciprocating rotating shaft 16 fits in (engages with) the dodecagonal hole 30. This hexagonal convex portion 16B is formed in a hexagonal shape when viewed along the axial direction of the reciprocating rotating shaft 16. The hexagonal convex portion 16B fits in the dodecagonal hole 30, thereby regulating a rotation of the base portion 20 relative to the reciprocating rotating shaft 16. Since the fitting angle of the dodecagonal hole 30 with respect to the hexagonal convex portion 16B is variable, the mounting angle of the base portion 20 (i.e., the processing brush 10) with respect to the reciprocating rotating shaft 16 is variable in a plurality of steps in the circumferential direction of the reciprocating rotating shaft 16. Specifically, the mounting angle of the processing brush 10 with respect to the reciprocating rotating shaft 16 can be changed every 30 degrees within a range between a position indicated by the alternate long and short dash line shown in FIG. 4 and a position indicated by the alternate long and two short dashes line shown in FIG. 4 (i.e., a range indicated by an arrow A in FIG. 4).

On the other hand, the brush portion 22 is formed of a plurality of (five in this case) channel brushes 32 which are mounted on a surface of the brush mounting portion 20B on the opposite side of the fixation portion 20A. These channel brushes 32 are arranged side by side in the width direction of the brush mounting portion 20B in the state where the lengthwise portions of the channel brushes are aligned along the longitudinal direction of the brush mounting portion 20B, and each channel (bottom) is fixed to the brush mounting portion 20B by means of welding or the like. In this structure, the brush portion 22 has a brush planting length L1 of about 100 mm and a brush planting width L2 of about 30 mm, for example.

A plurality of brush bristles 34 of the brush portion 22 extends to one side (side opposite to the side from which the fixation portion 20A extends) in the thickness direction of the brush mounting portion 20B in the state where the lengthwise portions of the brush bristles are aligned. The axial direction of the through-hole 24 in the fixation portion 20A is substantially perpendicular to the longitudinal direction of each brush bristle 34. In this embodiment, each of the brush bristles 34 is formed of nylon containing no abrasive, and has a diameter of 0.8 ϕ and a bristle length L3 of 100 mm. The brush portion 22 including the brush bristles 34 is disposed so as to extend from the base portion 20 to one side (in a direction indicated by an arrow B in FIGS. 1 and 2) along the radius of the reciprocating rotating shaft 16, in the state where the base portion 20 is fixed to the reciprocating rotating shaft 16. In other words, the brush portion 22 is provided on only one side along the radius of the reciprocating rotating shaft 16, and the brush portion 22 is not provided on the other side (in a direction indicated by an arrow C in FIGS. 1 and 2). During the reciprocating rotation of the reciprocating rotating shaft 16, the brush portion 22 (brush bristles 34) reciprocatingly oscillates (vibrates) at high speed in the circumferential direction of the reciprocating rotating shaft 16 (as indicated by an arrow D in FIG. 2).

(Operation and Effect)

Next, the operation and effect of this embodiment will be described.

In the brush-type processing device 12 having the structure described above, when the reciprocating rotating shaft 16 is allowed to reciprocatingly rotate at high speed by a driving force of the drive source 14, the brush portion 22 provided to the processing brush 10 reciprocatingly oscillates at high speed in the circumferential direction of the reciprocating rotating shaft 16. With this structure, the distal end of each of the brush bristles 34 of the brush portion 22 is pressed against the processed surface, thereby allowing the distal end of each of the brush bristles 34 to scrape off (knock out) an object to be removed (flash, dirt, etc.) on the processed surface. Moreover, in this case, the distal ends of the brush bristles 34, which reciprocatingly oscillate at high speed, repeatedly collide with the object to be removed from both sides in the reciprocating oscillation direction, with the result that the object to be removed can be effectively removed.

Figure 5A:
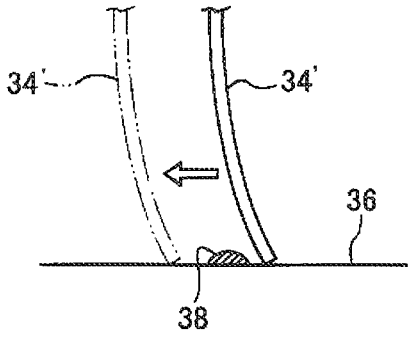
FIG. 5A is a schematic view for explaining a case where an object to be removed on a processed surface is removed by brush bristles that rotate in one direction.
Figure 5B:
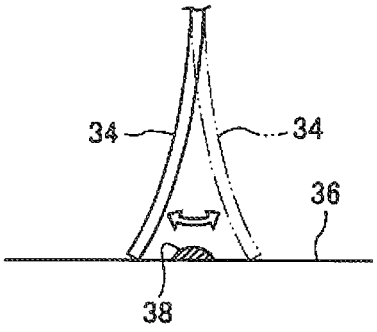
FIG. 5B is a schematic view for explaining a case where an object to be removed on a processed surface is removed by brush bristles that reciprocatingly oscillate.
Figure 6:
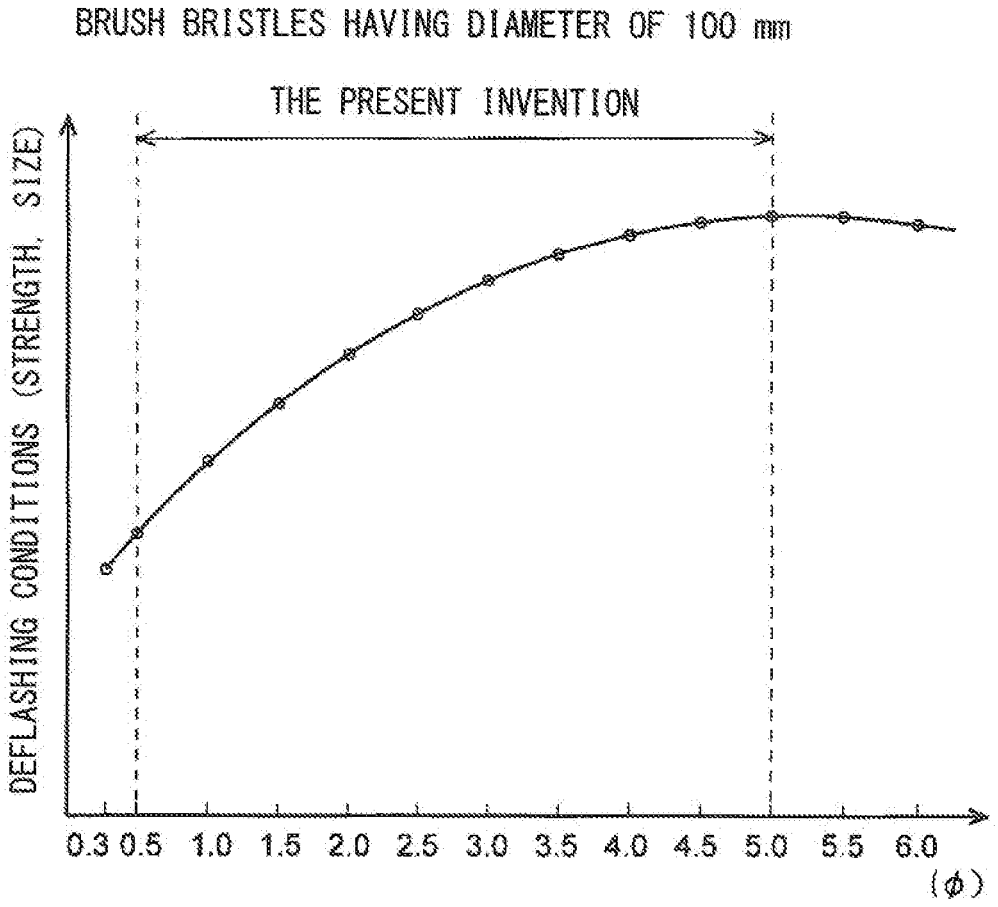
FIG. 6 is a graph showing test results obtained by conducting a comparative test on the processing efficiency of deflashing processing for a metal working component, by variously changing the diameter of each brush bristle, which is formed of nylon and has a bristle length of 100 mm, in a brush-type processing device similar to the brush-type processing device of this embodiment.

Specifically, as shown in FIG. 5A, in a structure in which brush bristles 34' move (rotate) in one direction, the distal ends of the brush bristles 34' collide with an object to be removed 38 on a processed surface 36 from only one side, so that the object to be removed 38 may not be sufficiently removed. On the other hand, in this embodiment, as shown in FIG. 5B, the object to be removed 38 is repeatedly knocked out by the distal ends of the brush bristles 34 from both sides, so that the object to be removed 38 can be effectively scraped off.

Further, since the brush bristles 34 extend to one side along the radius of the reciprocating rotating shaft 16, the speed of the reciprocating oscillation of the distal end of each brush bristle 34 can be made constant or substantially constant, regardless of a location. This prevents or suppresses occurrence of unevenness in the processing. Furthermore, since the base portion 20 is fixed to the reciprocating rotating shaft 16 of the drive source 14, the torque of the reciprocating rotating shaft 16 can be directly transmitted to the brush portion 22 extending from the base portion 20, and the brush portion 22 can be caused to reciprocatingly oscillate strongly. Specifically, in a structure in which the base portion is caused to reciprocatingly oscillate (vibrate) by a solenoid, for example, the base portion is driven by an elastic member, such as a return spring, in a return movement of the reciprocating movement. Accordingly, there is a possibility that the brush portion mounted to the base portion will not be caused to reciprocatingly move strongly. There is another possibility that the elastic member will lose strength, leading to a reduction in the force of the reciprocating oscillation. On the other hand, in this embodiment, the brush portion 22 can be caused to reciprocatingly oscillate strongly as described above, thereby making it possible to strongly scrape off the object to be removed from the processed surface.

As described above, in this embodiment, various processings such as deflashing, grinding, polishing, rubbing-up, washing, and finishing of the processed surface can be efficiently carried out.

Additionally, in this embodiment, the base portion 20 of the processing brush 10 is only required to be formed so as to be fixed to the reciprocating rotating shaft 16 and to be mounted with the brush portion 22. This leads to downsizing of the base portion 20. Consequently, the processing brush 10 and the brush-type processing device 12 can be reduced in weight.

Further, in this embodiment, when the fixation portion 20A, which is provided to the base portion 20 of the processing brush 10, is fixed to the reciprocating rotating shaft 16 of the drive source 14, the brush mounting portion 20B, which is provided to the base portion 20, is disposed along the reciprocating rotating shaft, and the brush portion (brush bristles 34) extends to the side opposite to the reciprocating rotating shaft 16 (drive source 14) through the brush mounting portion 20B. This facilitates application of a force when the drive source 14 is gripped to press the brush bristles 34 against the processed surface.

Furthermore, in this embodiment, the base portion 20 of the processing brush 10 is formed by bending a long metal sheet material at an intermediate portion in the longitudinal direction. Therefore, the base portion 20 can be formed with a compact, simple structure and cost reduction can be achieved.

Moreover, in this embodiment, each of the brush bristles 34 of the processing brush 10 is formed of nylon, and has a diameter of diameter of 0.8 ϕ and the bristle length L3 of 100 mm. Thus, the diameter of each of the brush bristles 34 formed of nylon is set to be relatively large, which makes it possible to effectively remove the object to be removed on the processed surface. In addition, the bristle length L3 of each of the brush bristles 34 is set to be relatively long as described above, which allows the brush bristles 34 to be favorably warped. Consequently, the brush bristles 34 can be made to favorably follow the concavo-convex pattern of the processed surface. Further, the distal ends of the brush bristles 34 can be easily inserted into a narrow gap (the distal ends of the brush bristles 34 are inserted into a narrow gap while being curved), which facilitates processing of the narrow gap. Furthermore, the distal end of each of the brush bristles 34 is scraped, so that an edge is formed at the distal end of each of the brush bristles 34. As a result, when the edge of each brush bristle collides with the object to be removed, the object to be removed can be effectively removed. This leads to a further improvement in the processing efficiency.

The present inventor compared the processing efficiencies (performances) of deflashing processing for metal working components by changing, in various manners, the diameter and bristle length of brush bristles formed of nylon in a brush-type processing device similar to the brush-type processing device 12 according to this embodiment. Specifically, in the deflashing processing for aluminum die-cast products having a plurality of minute grooves, the deflashing conditions (processing efficiencies) were compared. The following Table 1 shows the results.

TABLE 1

| | Diameter (ϕ) | Bristle length (mm) | Processing efficiency |
|---|---|---|---|
| Comparative Example 1 | 0.3 | 3 | x |
| Comparative Example 2 | 0.4 | 4 | Δ |
| Present Invention 1 | 0.5 | 5 | ○ |

TABLE 1-continued

| | Diameter (ϕ) | Bristle length (mm) | Processing efficiency |
|---|---|---|---|
| Present Invention 2 | 1.0 | 20 | ○ |
| Present Invention 3 | 1.5 | 50 | ○ |
| Present Invention 4 | 2.0 | 80 | ○ |
| Present Invention 5 | 2.5 | 100 | ○ |
| Present Invention 6 | 3.0 | 120 | ○ |
| Present Invention 7 | 3.5 | 140 | ○ |
| Present Invention 8 | 4.0 | 160 | ○ |
| Present Invention 9 | 4.5 | 180 | ○ |
| Present Invention 10 | 5.0 | 200 | ○ |
| Comparative Example 3 | 6.0 | 220 | Δ |
| Comparative Example 4 | 7.0 | 240 | x |
| Comparative Example 5 | 8.0 | 260 | x |

Note that in Table 1, ○ indicates the case where the flash was completely removed; Δ indicates the case where a slight flash was visually observed; and × indicates the case where a number of flashes were visually observed. As shown in Table 1, when the brush bristles 34 formed of nylon have a diameter in the range of 0.5 ϕ to 5 ϕ and a bristle length in the range of 5 mm to 200 mm, it has been confirmed that the processing efficiency of deflashing processing is improved as compared with the case where the diameter and bristle length are set to values outside the above-mentioned ranges. Since the diameters of the brush bristles 34 are determined depending on the specifications, the diameters may be different from the numerical values shown in Table 1. However, it is considered that the processing efficiency of deflashing processing is improved when the diameters are set in the range of numerical values as set forth herein.

In this embodiment, nylon used as the material of the brush bristles 34 contains no abrasive, so damage to the processed surface can be prevented or effectively suppressed. For example, dirt on the processed surface on which printing is performed can be scraped off without removing the print. In addition, for example, dirt on a painted surface of a vehicle can be scraped off without scratching the paint.

The processing brush 10 according to this embodiment has a structure in which the hexagonal convex portion 16B of the reciprocating rotating shaft 16 fits in the dodecagonal hole 30 of the rotation regulating portion 21 that is provided to the base portion 20. This structure can regulate the rotation of the base portion 20 relative to the reciprocating rotating shaft 16 of the drive source 14, and can change the mounting angle of the base portion 20 with respect to the reciprocating rotating shaft 16 in a plurality of steps in the circumferential direction of the reciprocating rotating shaft 16. This structure makes it possible to change the mounting angle of the base portion with respect to the reciprocating rotating shaft 16 (drive source 14), i.e., the direction in which the brush bristles 34 project from the reciprocating rotating shaft 16 (drive source 14), depending on the operation, thereby improving the workability.

As described above, the processing brush 10 and the brush-type processing device 12 according to this embodiment are capable of effectively performing various processings such as deflashing, grinding, polishing, rubbing-up, washing, and finishing of the processed surface. Accordingly, they are extremely effective as, for example, a deflashing device, a lapping device, or a cleaning device. These can also be effectively used as, for example, a fish scaler, or a device for removing dirt from shells.

Supplementary Explanation of Embodiment

The above embodiment illustrates a structure in which the rotation regulating portion 21 is joined with the fixation portion 20A of the base portion 20. However, the inventions as set forth herein are not limited to this, and instead may have a structure in which the rotation regulating portion 21 and the fixation portion 20A are integrally formed.

The above embodiment illustrates a structure in which the hexagonal convex portion 16B (engaging portion) of the reciprocating rotating shaft 16 fits in the dodecagonal hole 30 of the rotation regulating portion 21 (engaged portion). However, the inventions as set forth herein are not limited to this, and the shapes of the engaged portion and the engaging portion may be changed as appropriate.

The above embodiment illustrates a structure in which the mounting angle of the base portion 20 (processing brush 10) with respect to the reciprocating rotating shaft 16 is variable in a plurality of steps in the circumferential direction of the reciprocating rotating shaft 16. However, the inventions as set forth herein are not limited to this, and instead may have a structure in which the mounting angle of the processing brush with respect to the reciprocating rotating shaft is not variable.

The above embodiment illustrates the case where the brush portion 22 is formed of the plurality of channel brushes 32. However, the inventions as set forth herein are not limited to this, and the structure of the brush portion can be changed as appropriate. For example, a plurality of brush portions which constitute the brush portion may be directly planted in the base portion.

The above embodiment illustrates a structure in which the brush bristles 34 of the brush portion 22 extend to one side in the thickness direction of the brush mounting portion 20B in the state where the lengthwise portions of the brush bristles are aligned. However, the inventions according to exemplary implementations are not limited to this, and instead may have a structure in which the brush bristles 34 spread (i.e., the distances between the brush bristles 34 increase) toward the distal end side (side opposite to the base portion) of the brush portion 22.

The above embodiment illustrates a structure in which the brush bristles 34 are formed of nylon containing no abrasive. However, the inventions as set forth herein are not limited to this, and the brush bristles may be formed of material containing an abrasive. The material, diameter, bristle length, planting length, and planting width of the brush bristles can be changed as appropriate. For example, the brush bristles may be formed of a metallic material.

The above embodiment illustrates a structure in which the base portion 20 is formed by bending a long metal sheet material at an intermediate portion in the longitudinal direction. However, the inventions as set forth herein are not limited to this, and the material of the base portion can be changed as appropriate.

The above embodiment illustrates a structure in which the base portion 20 includes the fixation portion 20A and the brush mounting portion 20B. However, the invention as set forth herein is not limited to this, and the structure of the base portion can be changed as appropriate. For example, the base portion may be formed in a cylindrical shape and coaxially fixed to the reciprocating rotating shaft of the drive source. In this case, for example, a plurality of brush bristles is mounted to an outer peripheral portion of the cylindrical base portion.

The above embodiment illustrates a structure in which the body portion 18 of the drive source 12 can be gripped by an operator (i.e., a portable-type drive source is employed as the drive source). However, the invention as set forth herein is not limited to this, and instead may have, for example, a structure in which the brush-type processing device is mounted on a frame and a processed surface of a workpiece supported on the frame is processed by the brush-type processing device. Furthermore, for example, the brush-type processing device may be mounted to a robot arm.

The present invention can also be carried out by being modified in various manners without departing from the gist of the present invention. Needless to say, the scope of right of the present invention is not limited to the embodiments described above.

What is claimed is:

1. A processing brush comprising:

a base portion formed so as to be fixed to a reciprocating rotating shaft, the reciprocating rotating shaft being provided to a drive source and reciprocatingly rotating about an axis; and a brush portion that extends from the base portion to one side along a radius of the reciprocating rotating shaft and reciprocatingly oscillates in a circumferential direction of the reciprocating rotating shaft by the reciprocating rotation of the reciprocating rotating shaft;

wherein the base portion comprises:

a brush mounting portion fitted with a bottom of the brush portion; and a fixation portion extending from one end of the brush mounting portion to a side opposite to the brush portion, the fixation portion is fixed to the reciprocating rotating shaft such that the brush mounting portion is formed along the reciprocating rotating shaft and the brush portion extends to a side opposite to the reciprocating rotating shaft through the brush mounting portion, the base portion is formed by bending a long metal sheet material at an intermediate portion in a longitudinal direction, one end side in the longitudinal direction of the metal sheet material from a bent potion serves as the fixation portion, and the other end side in the longitudinal direction of the metal sheet material from the bent portion serves as the brush mounting portion, the brush portion includes brush bristles formed of nylon, and the brush bristles have a diameter in a range of 0.5 mm to 5 mm and a bristle length in a range of 5 mm to 200 mm, and a rotation of the base portion relative to the reciprocating rotating shaft is regulated by allowing an engaged portion provided to the fixation portion to be engaged with an engaging portion provided to the reciprocating rotating shaft, and a mounting angle of the base portion with respect to the reciprocating rotating shaft is variable in a plurality of steps in the circumferential direction of the reciprocating rotating shaft.

2. A brush-type processing device comprising:

a drive source that causes a reciprocating rotating shaft to reciprocatingly rotate by a driving force; and a processing brush according to claim 1, the base portion being fixed to the reciprocating rotating shaft.

* * * * *